US012648600B1

(12) United States Patent
Page

(10) Patent No.: US 12,648,600 B1
(45) Date of Patent: Jun. 9, 2026

(54) METHOD FOR ISOLATING PANTS FROM FLOOR CONTACT DURING USE OF COMMODE

(71) Applicant: Matthew Page, Russellville, TN (US)

(72) Inventor: Matthew Page, Russellville, TN (US)

( * ) Notice: Subject to any disclaimer, the term of this patent is extended or adjusted under 35 U.S.C. 154(b) by 5 days.

(21) Appl. No.: 18/920,275

(22) Filed: Oct. 18, 2024

Related U.S. Application Data

(60) Provisional application No. 63/606,561, filed on Dec. 5, 2023.

(51) Int. Cl.
*A41D 1/089* (2018.01)
*A41D 15/00* (2006.01)
*A41F 1/00* (2006.01)

(52) U.S. Cl.
CPC ..... *A41D 1/089* (2018.01); *A41D 15/002* (2013.01); *A41F 1/002* (2013.01)

(58) Field of Classification Search
CPC . A41D 1/06; A41D 1/089; A41D 1/22; A41D 10/00; A41D 13/1236; A41D 13/1254; A41D 2400/44; A41D 2400/70
USPC ..... 2/228
See application file for complete search history.

(56) References Cited

U.S. PATENT DOCUMENTS 2,236,636 A * 4/1941 Young ..... A41D 1/06 D2/742
2,281,984 A * 5/1942 Henry ..... A41D 13/02 D2/744
2,687,530 A 8/1954 Farnum
2,705,326 A 4/1955 Lahnstein et al.
3,812,539 A * 5/1974 Muehlberg ..... A41D 10/00 2/69.5
5,539,932 A 7/1996 Howard
7,966,672 B1 * 6/2011 Hagerman ..... A41D 15/002 2/86
7,971,272 B2 7/2011 Bailey et al.
2009/0019616 A1 * 1/2009 Smith ..... A41D 13/129 2/269
2014/0082823 A1 * 3/2014 Gordon ..... A41D 13/1236 2/114
2018/0092413 A1 * 4/2018 Reyes ..... A41D 1/06
2018/0132552 A1 * 5/2018 Rivera ..... A41D 13/1236
2018/0242669 A1 * 8/2018 Kirsch ..... A41F 19/00
(Continued)

FOREIGN PATENT DOCUMENTS

CN 210017932 U 2/2020
CN 213549920 U 6/2021
JP 6609652 B2 * 11/2019

OTHER PUBLICATIONS

Machine translation of JP6609652B2 obtained via Espacenet.com. Accessed on Jul. 26, 2025. (Year: 2019).*
(Continued)

*Primary Examiner* — Matthew R Marchewka
(74) *Attorney, Agent, or Firm* — Luedeka Neely, P.C.

(57) ABSTRACT

A method for isolating clothing, such as pants legs and particularly the legs of shorts, from floor contact during use of commode. The clothing has securement members and the user manipulates the clothing to roll or fold up and retain portions of the clothing with the securement members as the user transitions to a seated position on a commode, resulting in portions of the clothing being elevated a distance above the floor of at least about 6 inches to isolate all portions of the clothing from contact with the floor.

5 Claims, 5 Drawing Sheets

(56) References Cited

U.S. PATENT DOCUMENTS

| | | | | |
|---|---|---|---|---|
| 2021/0137186 | A1* | 5/2021 | Lai | A41D 27/20 |
| 2023/0240392 | A1* | 8/2023 | Lucas | A41D 15/002 2/69 |

OTHER PUBLICATIONS

Carousell, Black length adjustable shorts, Printout of webpage, https://www.carousell.sg/p/black-length-adjustable-shorts-1312764341/, Date of this NPL reference is Before Aug. 16, 2024.
Lifehacks, StackExchange, Avoiding trousers to get wet, Printout of webpage, https://lifehacks.stackexchange.com/questions/17439/avoiding-trousers-to-get-wet, Date of this NPL reference is before Aug. 16, 2024.
Poshmark, Eddie Bauer: Adjustable Length Shorts, Printout of webpage, https://poshmark.com, Date of this NPL reference is before Aug. 16, 2024.
YOUTUBE Video, https://www.youtube.com/watch?v=b7x7qVaXZV8, PDF of video, Date of this NPL reference is Before Aug. 16, 2024.

* cited by examiner

METHOD FOR ISOLATING PANTS FROM FLOOR CONTACT DURING USE OF COMMODE

FIELD

The present disclosure relates to a method for enabling a person to easily and cleanly be seated on a commode without having any part or portion of pants worn by the person contacting the floor.

BACKGROUND

When a person is seated on a commode, pants worn by the person are typically positioned downwardly on the legs of the person. While this facilitates use of the commode, portions of the pants, typically legs of the pants, can undesirably contact the floor below the commode.

The present disclosure advantageously provides a method for enabling a person to easily and cleanly be seated on a commode without having any part or portion of pants worn by the person contacting the floor.

SUMMARY

The disclosure advantageously provides a method for isolating pants legs from floor contact during use of commode.

In one aspect, the method according to the disclosure includes the steps of providing pants for wearing by a user, the pants having a waist, legs intersecting at a crotch, and a body between the waist and the crotch of the pants, with the legs of the pants extending downwardly on either side of the crotch of the pants, the pants also including a lower securement member located proximate a distal portion of each of the legs of the pants and an upper securement member located on the body of the pants to be positioned above and generally aligned with the lower securement member, the lower securement member releasably securable in position to the upper securement member;

The method includes a first user step including locating a user in a standing position with the pants being worn by the user with the waist of the pants proximate a waist of the user with the legs of the pants extending downwardly past the crotch of the pants In a second user step after the first user step the user locates in the standing position proximate a commode located on a floor with the user facing away from the commode in preparation for sitting on the commode and prior to sitting on the commode having the user roll or fold the legs of the pants upwardly to place the lower securement member in location with the upper securement member for operatively connecting the upper and lower securement members so that upper portions of the legs of the pants are proximate the body of the pants and lower portions of the legs of the pants are maintained proximate the crotch of the pants with all portions of the legs of the pants substantially at or above the elevation of the crotch of the pants;

In a third user step after the second user step the user transitions to a seated position on the commode while simultaneously grasping and lowering the pants so that the waist of the pants is at or slightly below knees of the user as the user transitions from the standing position of the second user step to being seated on the commode;

During the third user step and while the user is seated on the commode following completion of the third user step, all portions of the pants are above ankles of the user and all portions of the pants are elevated a distance above the floor of at least about 6 inches and all portions of the pants are thereby isolated from contact with the floor.

In another aspect, the disclosure provides a method for isolating clothing from floor contact during use of commode. This method includes the steps of providing clothing for wearing by a user, the clothing having a waist, distal clothing portions extending below a crotch region of the clothing, and a body between the waist and the crotch of the clothing, the clothing also including a lower securement member and an upper securement member, the lower securement member releasably securable in position to the upper securement member;

In a first user step, a user locates in a standing position with the clothing being worn by the user with the waist of the clothing proximate a waist of the user with the distal clothing portions of the clothing extending downwardly past the crotch of the clothing;

In a second user step after the first user step, the user is located in the standing position proximate a commode located on a floor with the user facing away from the commode in preparation for sitting on the commode and prior to sitting on the commode having the user roll or fold the distal clothing portions upwardly to place the lower securement member in location with the upper securement member for operatively connecting the upper and lower securement members so that all portions of the distal clothing portions are substantially at or above the elevation of the crotch region of the clothing;

In a third user step after the second user step the user transitions to a seated position on the commode while simultaneously grasping and lowering the clothing so that the waist of the clothing is at or slightly below knees of the user as the user transitions from the standing position of the second user step to being seated on the commode During the third user step and while the user is seated on the commode following completion of the third user step, all portions of the clothing are above ankles of the user and all portions of the clothing are elevated a distance above the floor of at least about 6 inches and all portions of the clothing are thereby isolated from contact with the floor.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
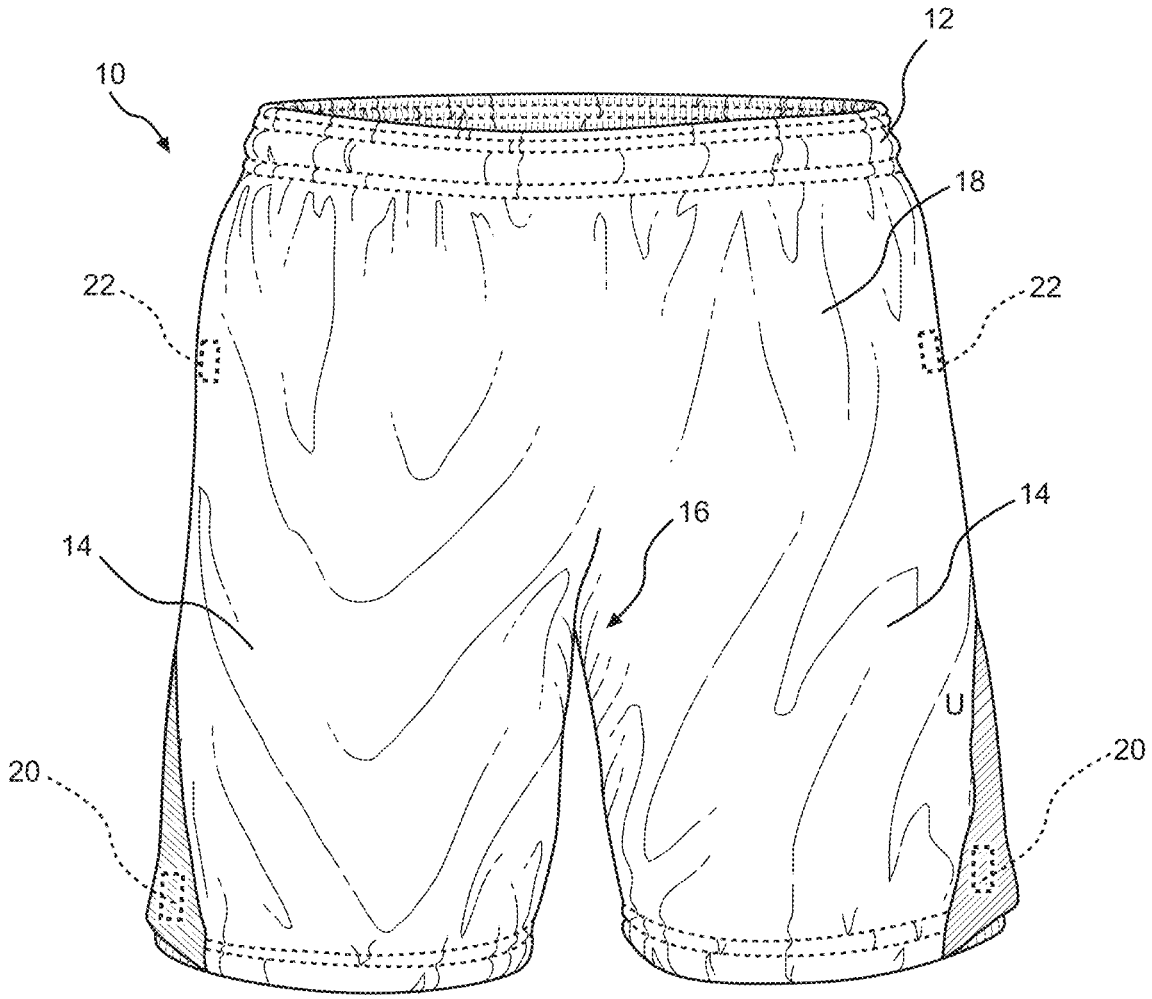
FIG. 1 is a frontal view of a pair of pants with which the method according to the disclosure is practiced with legs of the pants fully extended.

With reference to the drawings, the disclosure provides a method for isolating pants and especially legs of the pants from floor contact during use of commode. The method is simple and easily accomplished with little practice and reliably locates all portions of the pants to avoid contact with the floor.

In practice of the method, a user U will be wearing a pair of pants 10 having a waist 12, legs 14 intersecting at a crotch 16, and a body 18 between the waist 12 and the crotch 16. The legs 14 extend downwardly on either side of the crotch 16.

A lower securement member 20 is located proximate a distal portion of each of the legs 14, preferably along an out seam 14*a* of the leg 14 An upper securement member 22 is located on the body 18 so as to be positioned above and generally aligned with the lower securement member 20. The lower securement member 20 and the upper securement member 22 connectively cooperate so that the lower securement member 20 may be releasably secured in position to the upper securement member 22.

The lower securement member 20 and the upper securement member 22 are depicted as magnets that are attractive to one another and sewn into the material of the pants 10 at the noted locations. Thus, when the lower securement member 20 is brought near the upper securement member 22, the lower securement member 20 is releasably secured in position to the upper securement member 22, although they do not physically touch because of the material of the pants 10. The securement members 20 and 22 while described and shown as magnetic fasteners in the nature of magnets may also be mechanical fasteners such as ties or snaps or buttons or the like that are positionally securable on the pants 10 relative to one another.

As shown, the pants 10 are configured as short pants with the legs 14 generally extending to a location proximate or above a knee of the user U. It will be appreciated that the method of the invention may be practiced with the pants 10 as short pants as shown, and also with longer pants having legs extending past the knee of the user U and to the ankle of the user U, and pants having leg lengths therebetween. The method of the disclosure may also be practiced with other types of clothing such as skirts or dresses, where the skirt or dress has portions or regions corresponding to the locations of the waist, crotch, body and legs, with the portions of the skirt or dress extending below the crotch area being distal portions of the skirt or dress corresponding to the legs of the pants.

Figure 2:
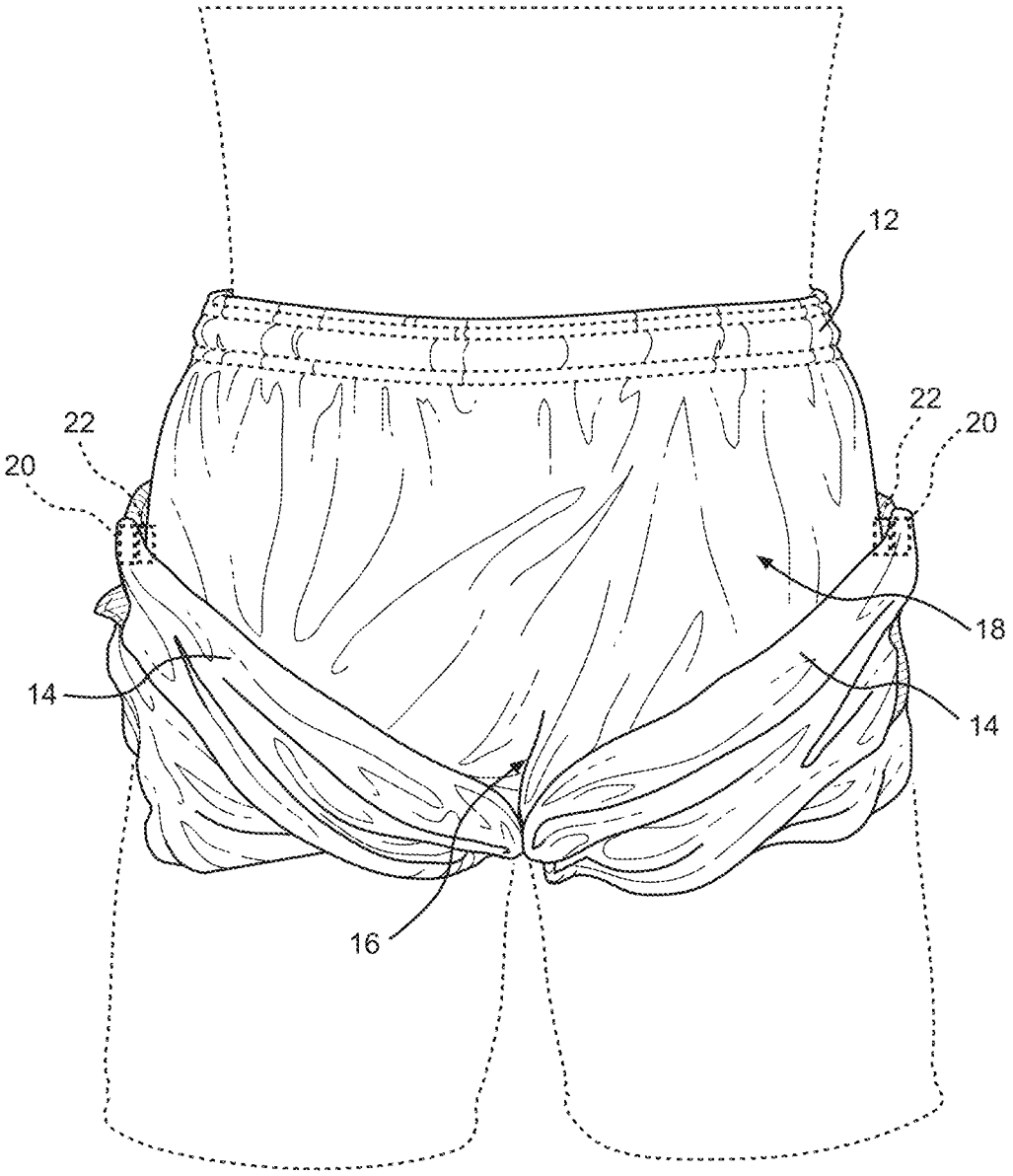
FIG. 2 shows the pants on the user with the legs of the pants retracted in accordance with one aspect of the method.
Figure 3:
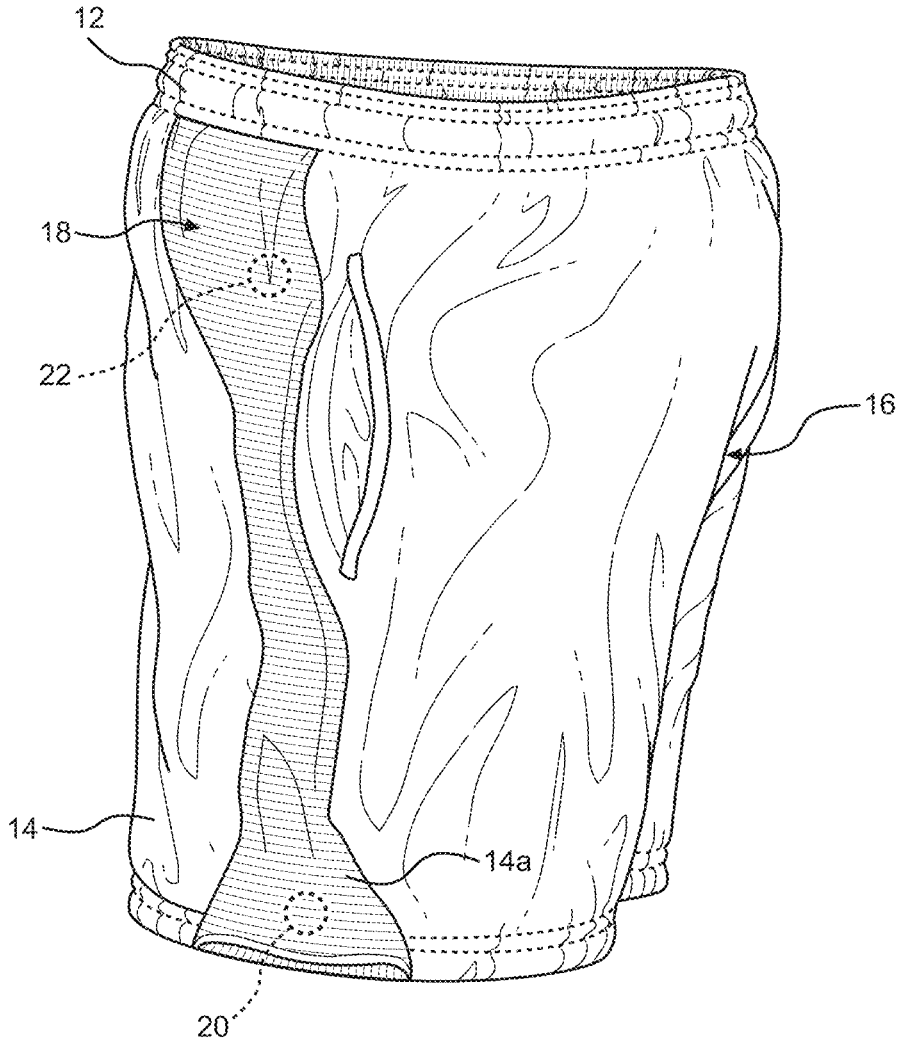
FIG. 3. is a side view of FIG. 1.
Figure 4:
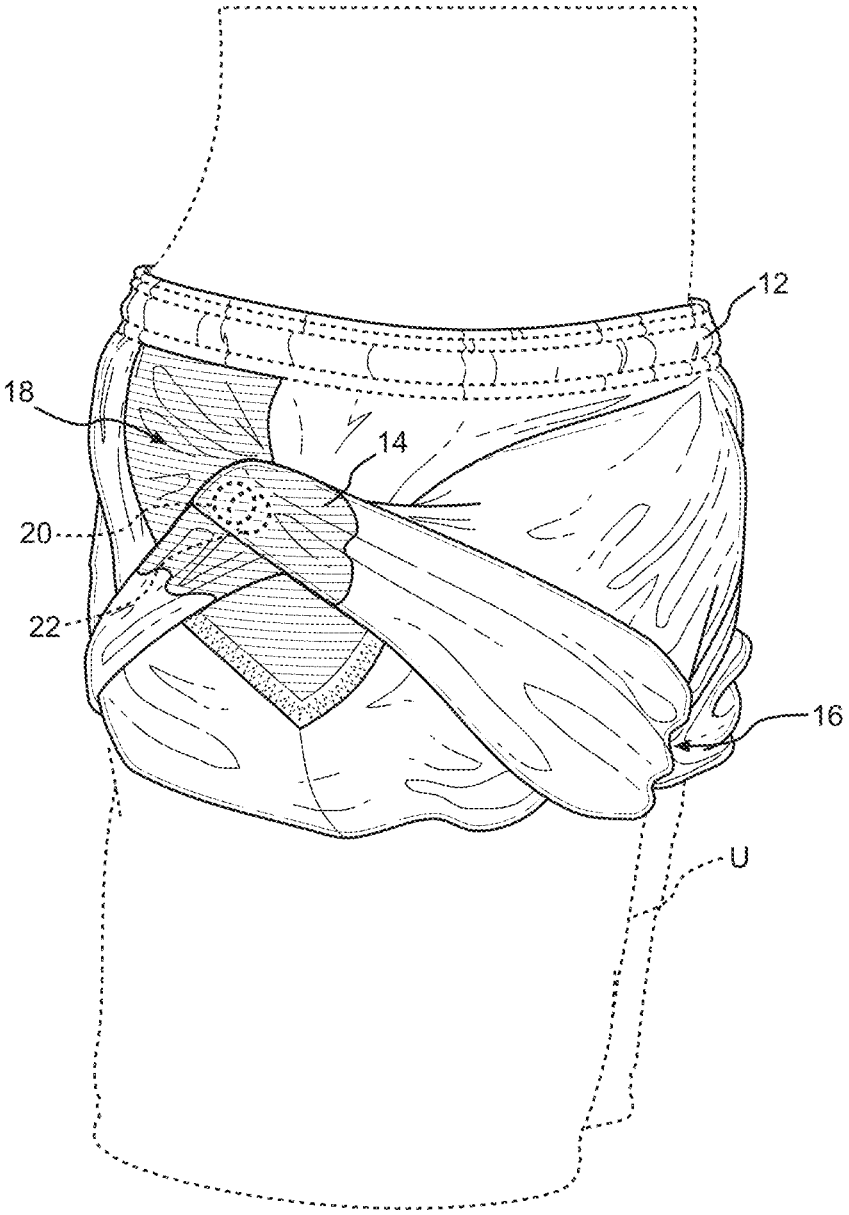
FIG. 4. is a side view of FIG. 2.

As shown in FIGS. 2 and 4, the legs 14 are rolled or folded upwardly to place the lower securement 20 in location with the upper securement member 22 for magnetically connecting the securement members 20 and 22. When the securement members 20 and 22 are magnetically connected the legs 14 are in the folded or rolled orientation and located so that most of the legs 14 are proximate the body 18 and lowermost portions of the legs 14 as secured are proximate the crotch 16. That is, the legs 14 are substantially at or above the elevation of the crotch 16.

FIGS. 2 and 4 depict the pants 10 with the legs 14 secured substantially at or above the elevation of the crotch 16, with the pants 10 on the user U in the typical wearing position with the waist 12 proximate the waist of the user U while the user U is standing. It is in this standing state that the user U will position the legs 14 as shown just prior to being seated on a commode C as shown in FIG. 5.

Once the pants 10 are configured with the legs 14 substantially at or above the elevation of the crotch 16, the standing user U will then proceed to a seated position on the commode C. The user U will then grasp and lower the pants 10 so that the waist 12 is at or slightly below knees K of the user U as the user U transitions from the standing position to being seated on the commode C, as shown in FIG. 5.

Figure 5:
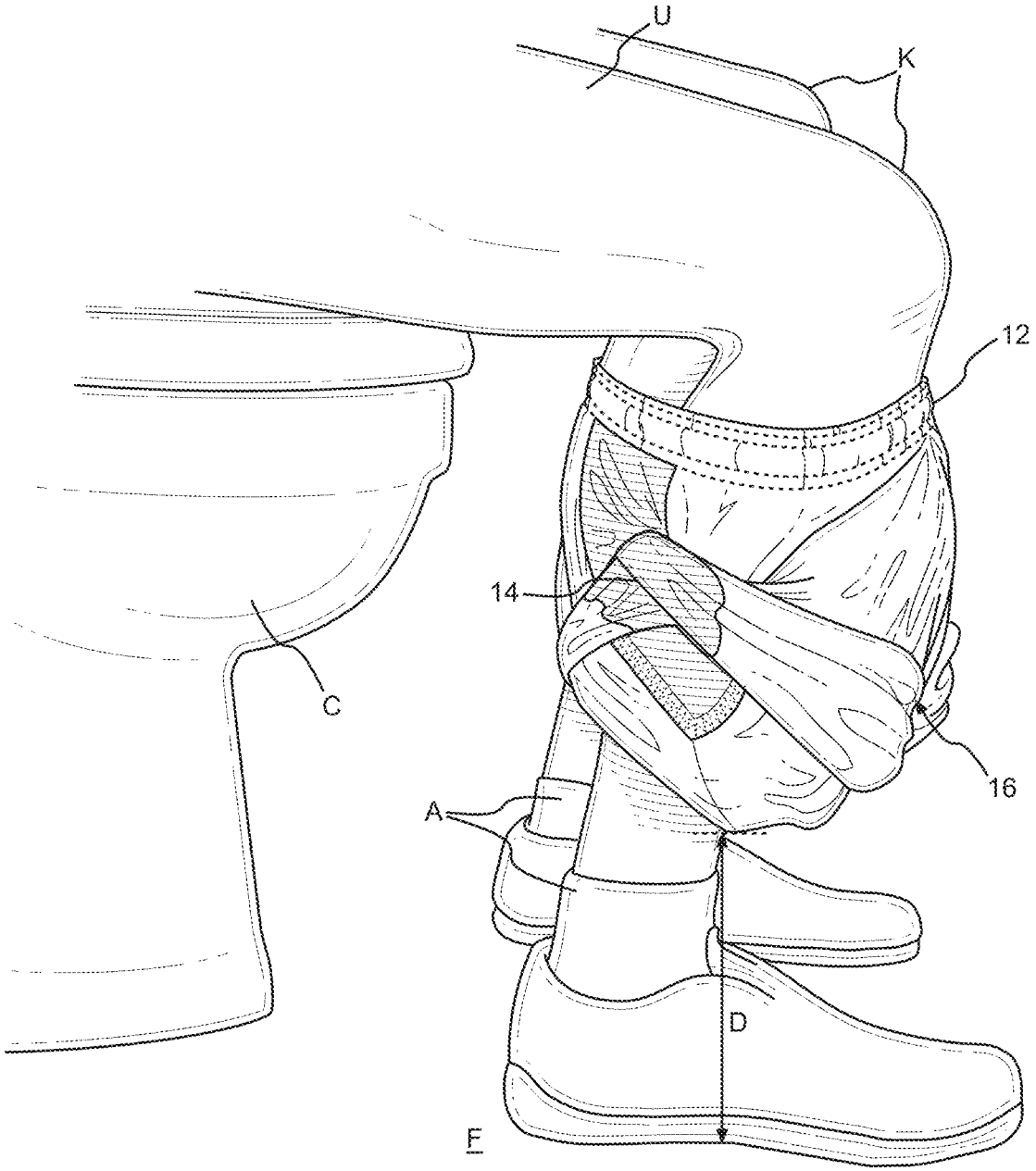
FIG. 5 depicts the user seated on a commode in accordance with the method without having any part or portion of pants worn by the user contacting the floor.

As depicted in FIG. 5, the lowermost portion of the pants 10, being a portion of the legs 14, is well above ankles A of the user U and elevated a distance D above floor F of at least about 6 inches. As will be appreciated, absent the described steps by the user U, the legs 14 of the pants 10 would not be elevated and would be in contact with the floor F when the user U is seated on the commode. Further, the method advantageously also locates the pants 10 so as to also not contact the commode C.

Once the user U has completed use of the commode C, the user U will return to the standing position. As the user U transitions from the seated position to the standing position, the user U will grasp and raise the pants 10 so that the waist 12 is proximate the waist of the user U. The user U may then release the securement members 20 and 22 from connection with one another and return the legs 14 to their unsecured positions.

Thus, throughout the use of the commode C by the user U no portion of the pants 10 has been in a position to contact the floor F or the commode C. In this manner, the method advantageously enables the user U to isolate all portions of the pants 10 from contact with the floor F and the commode C during use of the commode C.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A method for isolating pants legs from floor contact during use of commode, comprising the steps of:

providing pants for wearing by a user, the pants having a waist, right and left tubular legs intersecting at a crotch of the pants, and a body between the waist and the crotch of the pants, with the right and left tubular legs of the pants extending downwardly on either side of the crotch of the pants, the pants also including a right lower securement member affixed to the right tubular leg of the pants and located proximate a distal portion of the right tubular leg of the pants, a right upper securement member affixed to the body of the pants and located on the body of the pants to be positioned above and generally aligned with the right lower securement member, the right lower securement member releasably securable in position to the right upper securement member, a left lower securement member affixed to the left tubular leg of the pants and located proximate a distal portion of the left tubular leg of the pants, and a left upper securement member affixed to the body of the pants and located on the body of the pants to be positioned above and generally aligned with the left lower securement member, the left lower securement member releasably securable in position to the left upper securement member;

a first user step comprising locating the user in a standing position with the pants being worn by the user with the waist of the pants proximate a waist of the user with the right and left tubular legs of the pants extending downwardly past the crotch of the pants;

a second user step after the first user step, the second user step comprising locating the user in the standing position proximate a commode located on a floor with the user facing away from the commode in preparation for sitting on the commode and prior to sitting on the commode having the user roll or fold the right and left tubular legs of the pants upwardly to place the right lower securement member in location with the right upper securement member for operatively connecting the right upper and the right lower securement members, and to place the left lower securement member in location with the left upper securement member for operatively connecting the left upper and the left lower securement members so that upper portions of the right and left tubular legs of the pants are proximate the body of the pants and lower portions of the right and left tubular legs of the pants are maintained proximate the crotch of the pants with all portions of the right and left tubular legs of the pants substantially at or above an elevation of the crotch of the pants;

a third user step after the second user step, the third user step comprising the user transitioning to a seated position on the commode while simultaneously grasping and lowering the pants so that the waist of the pants is at or slightly below knees of the user as the user transitions from the standing position of the second user step to being seated on the commode;

wherein during the third user step and while the user is seated on the commode following completion of the third user step, all portions of the pants are above ankles of the user and all portions of the pants are elevated a distance above the floor of at least 6 inches and all portions of the pants are thereby isolated from contact with the floor and from contact with the commode.

2. The method of claim 1, wherein the pants comprise short pants.

3. The method of claim 1, wherein the upper and lower securement members comprise magnets.

4. The method of claim 1, further comprising a fourth user step after the third user step, the fourth user step comprising the user transitioning from the seated position back to the standing position while simultaneously grasping and raising the pants so that the waist of the pants is retuned to a position proximate the waist of the user.

5. The method of claim 4, further comprising a fifth user step after the fourth user step, the fifth user step comprising the user releasing the right and left upper and the right and left lower securement members from connection with one another and returning the right and left bua legs of the pants to lowered positions below the crotch of the pants.

* * * * *